US008948632B2

(12) United States Patent
Yokoi

(10) Patent No.: US 8,948,632 B2
(45) Date of Patent: Feb. 3, 2015

(54) IMAGE FORMING APPARATUS AND IMAGE FORMATION CORRECTING METHOD

(75) Inventor: Junichi Yokoi, Kariya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 168 days.

(21) Appl. No.: 13/619,323

(22) Filed: Sep. 14, 2012

(65) Prior Publication Data

US 2013/0136472 A1 May 30, 2013

(30) Foreign Application Priority Data

Nov. 28, 2011 (JP) ..... 2011-259246

(51) Int. Cl.
*G03G 15/00* (2006.01)

(52) U.S. Cl.
USPC ..... 399/49; 399/51; 399/55; 399/72

(58) Field of Classification Search
USPC ..... 399/49, 51, 55, 72
See application file for complete search history.

(56) References Cited

U.S. PATENT DOCUMENTS

2002/0028085 A1* 3/2002 Nakazato et al. ..... 399/49
2004/0165899 A1 8/2004 Chigira
2008/0192272 A1 8/2008 Yamada
2011/0001990 A1 1/2011 Takatsuka
2011/0052232 A1* 3/2011 Ohshima et al. ..... 399/49

FOREIGN PATENT DOCUMENTS

JP 2003-182151 A 7/2003
JP 2004-114343 A 4/2004
JP 2004-258281 A 9/2004
JP 2008-246997 A 10/2008
JP 2011-013397 A 1/2011

* cited by examiner

*Primary Examiner* — Ryan Walsh
(74) *Attorney, Agent, or Firm* — Merchant & Gould PC

(57) ABSTRACT

An image forming apparatus including: a photosensitive member; a conveying member; an exposure head; a developing unit; an image forming unit; a concentration sensor having a first detection width in a conveyance direction and a second detection width in an axial direction of the photosensitive member; and a control unit, wherein the control unit controls the exposure head and the image forming unit to form a first image for correction, which includes a straight line part extending in the axial direction of the photosensitive member and having a length equal to or larger than the second detection width of the concentration sensor, on the conveying member, and wherein the control unit corrects a developing bias to be applied to the developing unit based on a detection result of the first image for correction by the concentration sensor.

12 Claims, 12 Drawing Sheets

IMAGE FORMING APPARATUS AND IMAGE FORMATION CORRECTING METHOD

CROSS-REFERENCE TO RELATED APPLICATIONS

This application claims priority from Japanese Patent Application No. 2011-259246 filed on Nov. 28, 2011, the entire contents of which are incorporated herein by reference.

TECHNICAL FIELD

Aspects of the present invention relate to an image forming apparatus and an image formation correcting method, and more particularly, to developing-bias correction and gamma correction relative to image formation.

BACKGROUND

JP-A-2004-114343 discloses a technology for forming concentration patches (dither patterns) by changing concentration patch data (dither pattern data) for each printing condition and using results of measuring of concentrations of the concentration patches to perform concentration correction (gamma correction) on print images.

Developing-bias correction is sometimes performed before gamma correction is performed. However, if the developing-bias correction is performed with concentration patches (images for correction) formed by LED exposure with a large amount of defocusing, there is a fear that correction widths of developing biases will become larger than expected and the reproducibility of isolated dots, thin lines, and the like will become lower.

SUMMARY

An object of the present invention is to provide a technology for suppressing an increase in a correction width of a developing bias for image concentration correction in an image forming apparatus having an exposure head.

According to an aspect of the present invention, there is provided an image forming apparatus including: a photosensitive member extending in an axial direction; a conveying member configured to convey a recording medium in a predetermined conveyance direction; an exposure head disposed close to the photosensitive member and configured to form a latent image on the photosensitive member by performing exposure based on image data; a developing unit configured to develop the latent image formed on the photosensitive member; an image forming unit configured to form an image obtained by the developing by the developing unit on the recording medium or the conveying member; a concentration sensor configured to detect an image and has a first detection width which is a detection width in the conveyance direction and a second detection width which is a detection width in the axial direction of the photosensitive member; and a control unit, wherein the control unit controls the exposure head and the image forming unit to form a first image for correction, which includes a straight line part extending in the axial direction of the photosensitive member and having a length equal to or larger than the second detection width of the concentration sensor, on the conveying member, and wherein the control unit corrects a developing bias to be applied to the developing unit for developing the latent image based on a detection result of the first image for correction by the concentration sensor.

According to another aspect of the present invention, there is provided an image formation correcting method of performing correction relative to image formation in an image forming apparatus which includes a photosensitive member extending in an axial direction; a conveying member configured to convey a recording medium in a predetermined conveyance direction, an exposure head disposed close to the photosensitive member and configured to form a latent image on the photosensitive member by performing exposure based on image data, a developing unit configured to develop the latent image formed on the photosensitive member, an image forming unit configured to form an image obtained by the developing by the developing unit on the recording medium or the conveying member and a concentration sensor configured to detect an image and has a first detection width which is a detection width in the conveyance direction and a second detection width which is a detection width in the axial direction of the photosensitive member, the method including: controlling the exposure head and the image forming unit to form a first image for correction, which includes a straight line part extending in the axial direction of the photosensitive member and having a length equal to or larger than the second detection width of the concentration sensor, on the conveying member; correcting a developing bias to be applied to the developing unit for developing the latent image based on a detection result of the first image for correction by the concentration sensor; and after correcting the developing bias, forming two or more types of second images for correction, each having a predetermined concentration, on the conveying member, and performing gamma correction based on detection results of the second images for correction by the concentration sensor.

According to the present invention, in the exposure head such as a LED exposure head disposed close to the photosensitive member, since a depth of focus is small, defocusing is likely to occur. Also, in general, in a case where defocusing occurs, an exposure range tends to widen in the axis direction of the photosensitive member. For this reason, the image for correction is configured by the straight line portions extending in the axis direction of the photosensitive member. Therefore, it is possible to suppress the influence of defocusing on the concentration detection of the image for correction, that is, errors in the concentration detection. As a result, in an image forming apparatus having an exposure head with a small depth of focus, it is possible to suppress an increase in a change width of a developing bias for image concentration correction such that the developing-bias correction is appropriately conducted.

DETAILED DESCRIPTION

<Exemplary Embodiment>

A first exemplary embodiment will be described with reference to FIGS. 1 to 12.

1. Entire Configuration of Color Printer

Figure 1:
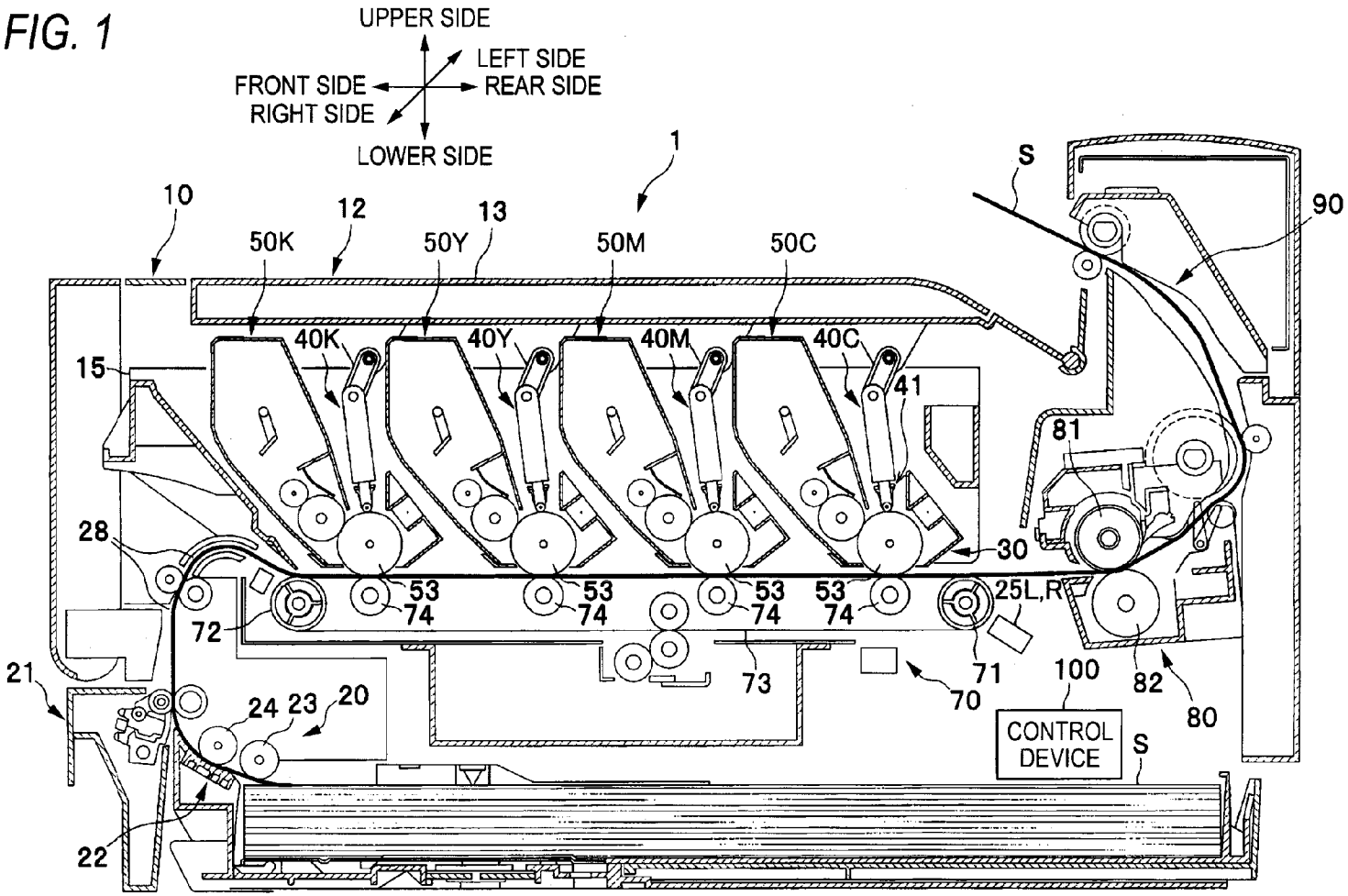
FIG. 1 is a sectional side view illustrating a main portion of a color printer according to a first exemplary embodiment.

FIG. 1 is a sectional side view schematically illustrating a main portion of an electrophotographic color printer 1 according to the first exemplary embodiment. The color printer 1 is an example of an image forming apparatus. As shown in FIG. 1, the color printer 1 includes a paper feeding unit 20 that feeds a sheet S, an image forming unit 30 for forming an image on the fed sheet (an example of a recording medium) S, a discharging unit 90 that discharges the sheet S having the image formed thereon and a control device 100 that controls the operation of each of the above-mentioned units, which are contained in a main body casing 10.

In the following description, directions are described based on a user facing the color printer during its use. More specifically, referring to FIG. 1, the left side and the right side of the drawing sheet are referred to as a "front side" and a "rear side" of the color printer, respectively. Also, a back side of the drawing sheet is referred to as a "left side", and a front side of the drawing sheet is referred to as a "right side". Also, an upward and downward direction in FIG. 1 is referred to as an "upper-lower direction". Also, the image forming apparatus is not limited to the color printer 1, but may be a monochrome printer, a multi-function apparatus having a copy function and a fax function, or the like.

On an upper part of the main body casing 10, an openable and closable upper cover 12 is provided. The top of the upper cover 12 configures a discharge tray 13 for accumulating sheets S discharged from the main body casing 10. Below the discharge tray 13, there are provided four LED units 40K, 40Y, 40M, and 40C as examples of an exposing unit. The four LED units 40K to 40C form electrostatic latent images corresponding to four colors, black K, yellow Y, magenta M and cyan C, to be developed with toner corresponding to the individual colors.

The paper feeding unit 20 is provided at the lower portion of the main body casing 10, and mainly includes a paper feed tray 21 that is detachably installed into the main body casing 10, and a paper feeding mechanism 22 that conveys sheets S from the paper feed tray 21 to the image forming unit 30. The paper feeding mechanism 22 is provided on the front side of the paper feed tray 21, and mainly includes a paper feeding roller 23 and a separation roller 24.

The paper feeding unit 20 configured as describe above separates a stack of sheets S stored in the paper feed tray 21 and conveys a sheet S on one-by-one basis upwardly toward the image forming device 30, during which the sheet S passes conveyance path 28 and thereafter the sheet conveyance direction of the sheet S is reversed in the rearward direction.

The image forming unit 30 includes four processing cartridges 50K, 50Y, 50M, and 50C, a transferring unit 70, and a fixing unit 80. The four processing cartridges 50K to 50C develop the electrostatic latent images corresponding to the individual colors with the toner of the four colors, respectively.

Figure 2:
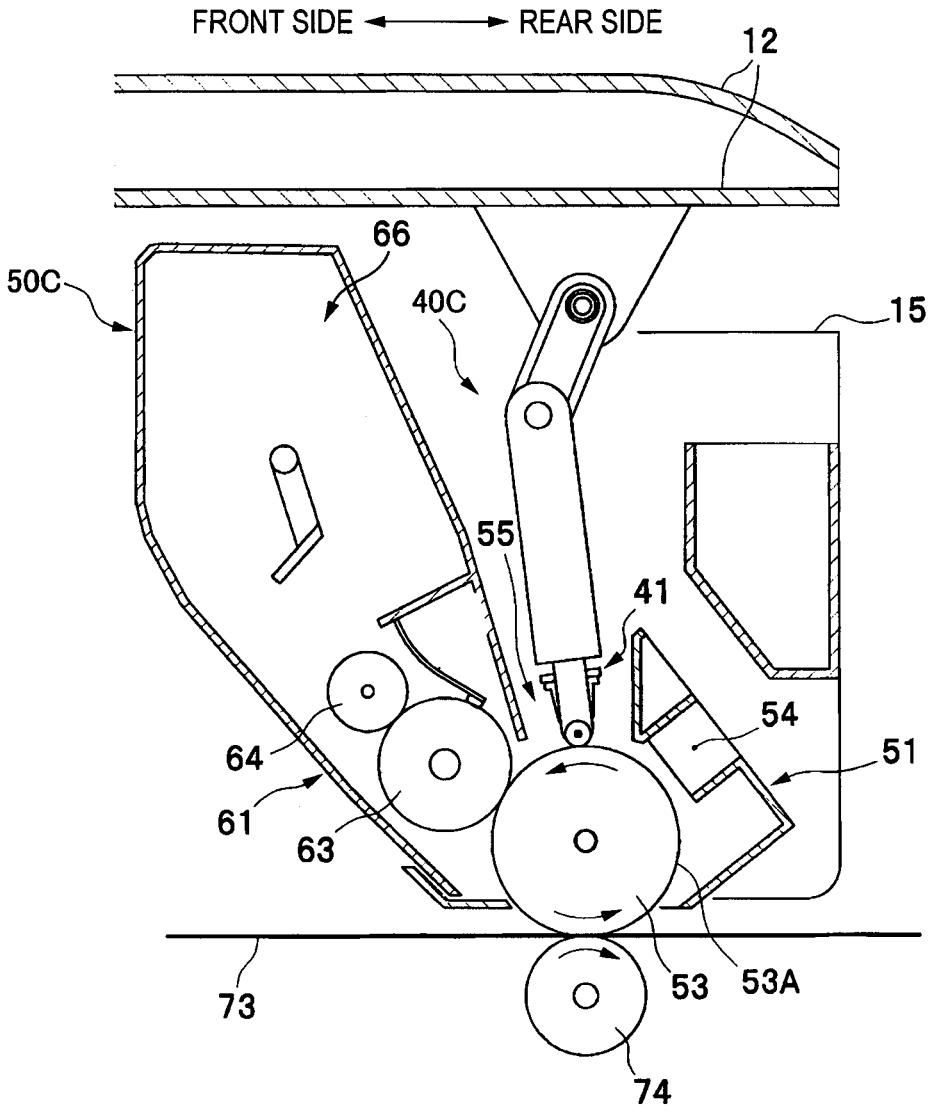
FIG. 2 is an enlarged view illustrating an LED unit and a processing cartridge.

The processing cartridges 50K to 50C are disposed in parallel in the front-rear direction between the upper cover 12 and the paper feeding unit 20, and respectively include drum units 51, and developing units 61 that are detachably installed with respect to the drum units 51, as shown in FIG. 2. The processing cartridges 50 support photosensitive drums 53. Also, the processing cartridges 50K to 50C have the same configuration except that they contain the toner of different colors in toner containing units 66 of the developing units 61.

The drum units 51 include the photosensitive drums 53 which are examples of a photosensitive member, and scorotron type chargers 54.

The developing units 61 include developing rollers 63, feed rollers 64, and the toner containing units 66 that contain the toner (corresponding to a developer). The developing rollers 63 correspond to a developing unit. The developing rollers 63 apply developing biases DIV to the photosensitive drums 53 to attach the toner to the photosensitive drums 53, thereby developing the electrostatic latent images on the photosensitive drums 53 such that developer images are formed.

The developing units 61 are installed into the drum units 51, such that exposure holes 55 facing the photosensitive drums 53 from the upper side are formed as shown in FIG. 2. Into the lower ends of the exposure holes 55, the LED units 40 holding LED exposure heads 41 are inserted.

Figure 3:
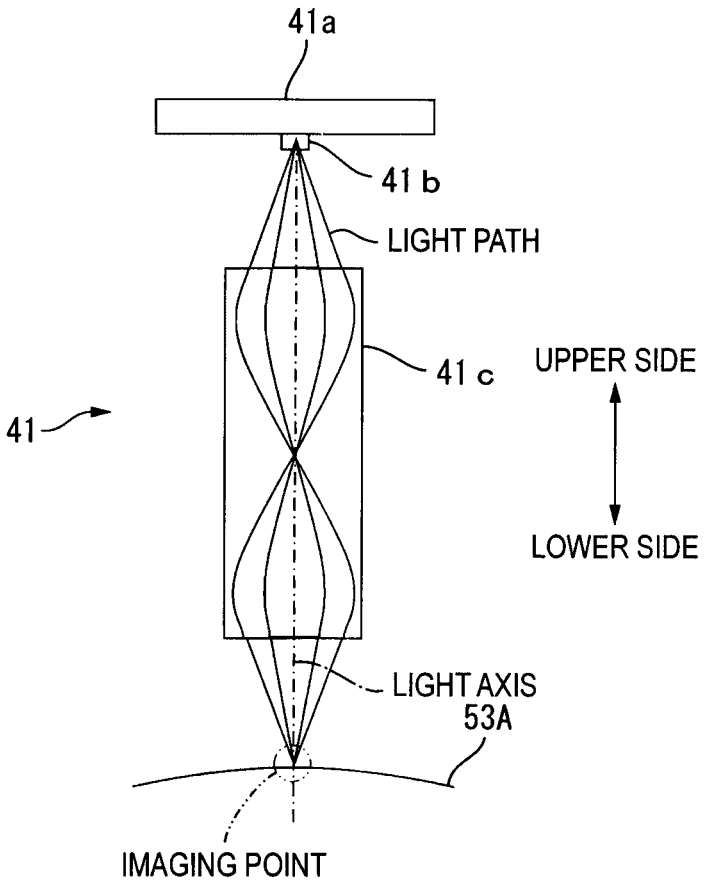
FIG. 3 is an explanatory view illustrating an LED exposure head.

The LED exposure heads (examples of an exposure head) 41 include a plurality of light emitting elements P aligned in a main scan direction perpendicular to the conveyance direction (the front/rear direction) of the sheet S. The main scan direction is the same as the width direction of a conveyance belt 73. As shown in FIG. 3, the LED exposure heads 41 include circuit boards 41*a*, LED array chips 41*b*, and diffractive index distribution type rod lens arrays 41*c*. Specifically, on each circuit board 41*a*, for example, 20 LED array chips 41*b* are disposed in a zigzag manner in the main scan direction. Each LED array chip 41*b* is formed by a semiconductor process, and includes a plurality of LEDs (light emitting diodes) formed as examples of the light emitting elements P on a semiconductor substrate. The diffractive index distribution type rod lens arrays 41*c* are provided on the light output sides of the LED array chips 41*b*.

Also, in the main body casing 10, cartridge drawers 15 are provided to accommodate the processing cartridges 50 such that the processing cartridges 50 are detachable.

As shown in FIG. 1, the transferring unit 70 is installed between the paper feeding unit 20 and the processing cartridges 50, and includes a driving roller 71, a driven roller 72, the conveyance belt (an example of a conveying member) 73, and transfer rollers 74.

The conveyance belt 73 stretches between the driving roller 71 and the driven roller 72. The outer surface of the conveyance belt 73 is in contact with the individual photosensitive drums 53. Also, on the inner side of the conveyance belt 73, four transfer rollers 74 are disposed to face the photosensitive drums 53, respectively, with the conveyance belt 73 interposed between the transfer rollers 74 and the photosensitive drums 53. During transferring, a transfer bias is applied to the transfer rollers 74.

The fixing unit 80 is disposed on the rear side of the processing cartridges 50 and the transferring unit 70, and includes a heating roller 81 and a pressing roller 82 that presses the heating roller 81.

In the image forming unit 30 configured as described above, first, photosensitive surfaces 53A which are the surfaces of the photosensitive drums 53 are uniformly charged by the scorotron type chargers 54, and then are exposed by LED beams irradiated from the LED exposure heads 41. As a result, the potentials of the exposed portions drop, such that electrostatic latent images based on image data are formed on the photosensitive drums 53.

Also, the toner stored in the toner containing units 66 is fed to and carried on the developing rollers 63 by the rotation of the feed rollers 64. When the developing rollers 63 are in contact with the photosensitive drums 53, if the developing biases DIV are applied, the toner carried on the developing rollers 63 is fed to the electrostatic latent images formed on the photosensitive drums 53. As a result, the toner is selectively carried on the photosensitive drums 53 such that the electrostatic latent images are visualized, that is, toner images (developer images) are formed by reversal development.

Next, when the sheet S having been fed onto the conveyance belt 73 passes between the photosensitive drums 53 and the transfer rollers 74, the toner images formed on the photosensitive drums 53 are transferred onto the sheet S. Subsequently, the sheet S passes between the heating roller 81 and the pressing roller 82, whereby the transferred toner image is thermally fixed on the sheet S. The sheet S having been subjected to the thermal fixing is discharged to the outside of the main body casing 10 through the discharging unit 90 and is accumulated on the discharge tray 13.

Also, on the lower side of the rear side of the conveyance belt 73, two concentration detecting sensors (examples of a concentration sensor) 25L and 25R are installed. The concentration detecting sensors 25L and 25R have a first detection width DW1 which is a detection width in the paper conveyance direction (the front/rear direction in FIG. 1), and a second detection width DW2 which is a detection width in the axial direction of the photosensitive drums 53 (the left/right direction in FIG. 1), and detect the concentration of an image 5 for developing-bias correction (corresponding to a first image for correction) formed on the conveyance belt 73 (see FIG. 6). In the present exemplary embodiment, as described above, the two concentration detecting sensors 25L and 25R are installed, an average of detection image concentrations detected by the concentration detecting sensors 25L and 25R is obtained, and the developing biases DIV are corrected based on the average concentration value.

Specifically, the concentration detecting sensors 25L and 25R are disposed to face both end portions of the conveyance belt 73 in the width direction (the left/right direction), respectively. The concentration detecting sensors 25L and 25R are, for example, reflection type optical sensors having light emitting elements (for example, LEDs) and light receiving elements (for example, phototransistors). Specifically, the light emitting elements irradiate the surface of the conveyance belt 73 with spot light SP from an oblique direction, and the light receiving elements receive the reflected light of the spot light SP from the surface of the conveyance belt 73. Then, each of the concentration detecting sensors 25L and 25R detects the concentration of the image 5 for developing-bias correction formed on the conveyance belt 73, according to the level of the reflected light. According to the detected concentration of the image 5 for developing-bias correction, the developing biases to be applied to the developing rollers 63 are corrected. Here, the spot light SP has the first detection width DW1 and the second detection width DW2 on the image 5 for developing-bias correction (see FIG. 6).

2. Description of Control Device and Developing-Bias Generating Circuit

The control device 100 controls the entire color printer 1, and includes a calculation control unit 100A configured by a CPU and the like, a register 102, and an Electrically Erasable Programmable Read-Only Memory (EEPROM) 104.

The control device 100 corrects the developing biases DIV to be applied to the image forming unit 30 for developing latent images based on the detection results of the image 5 for developing-bias correction by the concentration sensors 25, as will be described later. Specifically, the developing biases DIV are applied to the developing rollers 63 of the image forming unit 30. Also, the control device 100 controls the LED exposure heads 41 and the image forming unit 30 such that transverse lines (corresponding to straight line portions) 6 of the image 5 for developing-bias correction are formed with lengths equal to or larger than the second detection width DW2 of the concentration sensors 25. That is, the control device 100 is an example of a control unit.

The EEPROM 104 stores programs to be executed by the calculation control unit 100A, a correction table RT for developing-bias correction, and so on. A portion of data stored in the correction table RT is set in the register 102.

Figure 4:
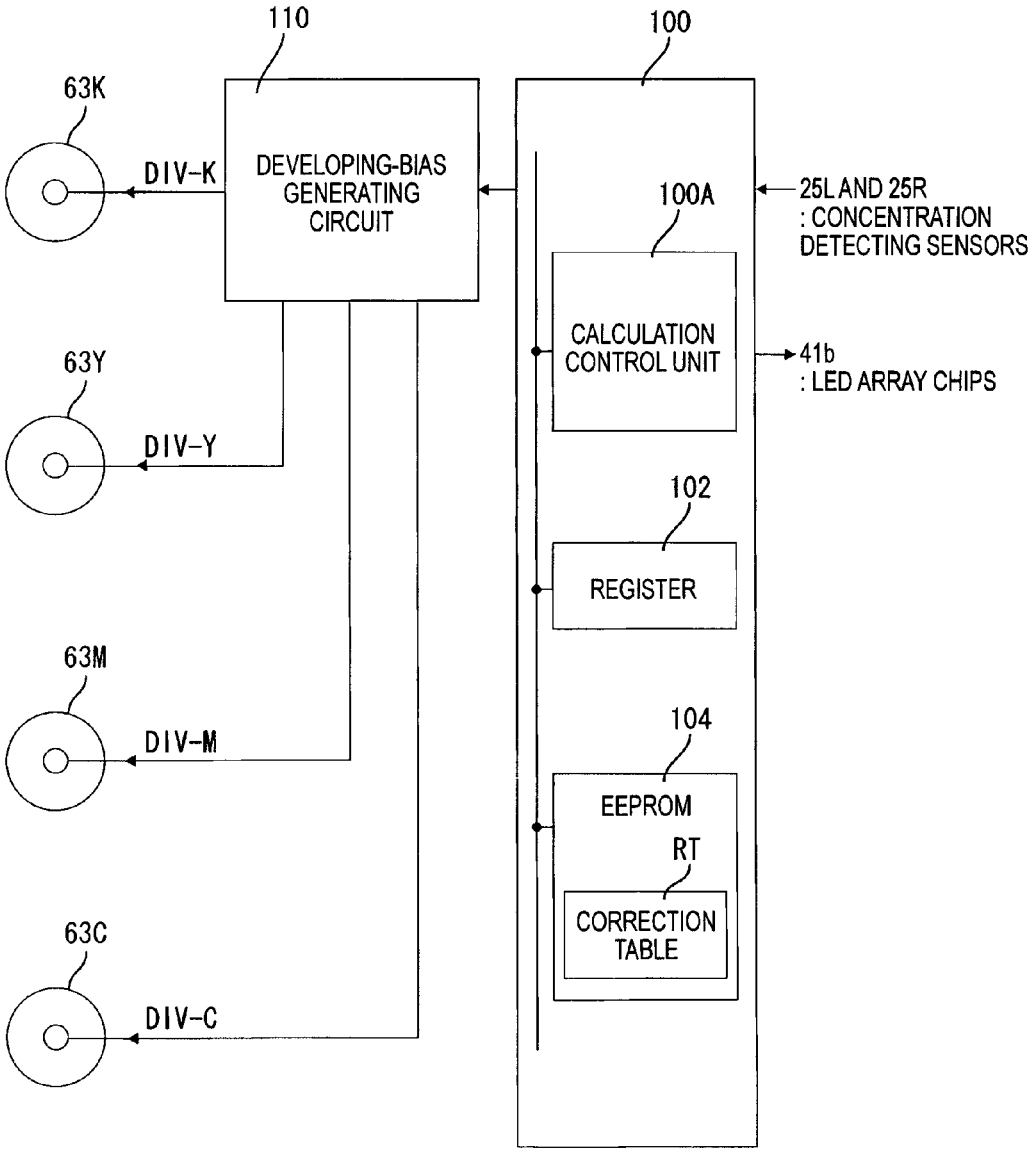
FIG. 4 is a block diagram illustrating a developing-bias generating circuit and a control device.

A developing-bias generating circuit 110 generates the developing biases DIV-K, DIV-Y, DIV-M, and DIV-C to be applied to the developing rollers 63, according to the control of the control device 100. The developing-bias generating circuit 110 is, for example, a self-excited high-voltage generating circuit including an oscillating transistor and a transformer. The voltage value of the output voltage of the developing-bias generating circuit 110, that is, the developing biases DIV are controlled, for example, based on a pulse width modulation (PWM) signal from the control device 100. Also, although FIG. 4 shows an example in which one developing-bias generating circuit 110 generates the individual developing biases DIV, separate developing-bias generating circuits may generate the developing biases DIV, respectively.

3. Image for Developing-Bias Correction

Figure 5:
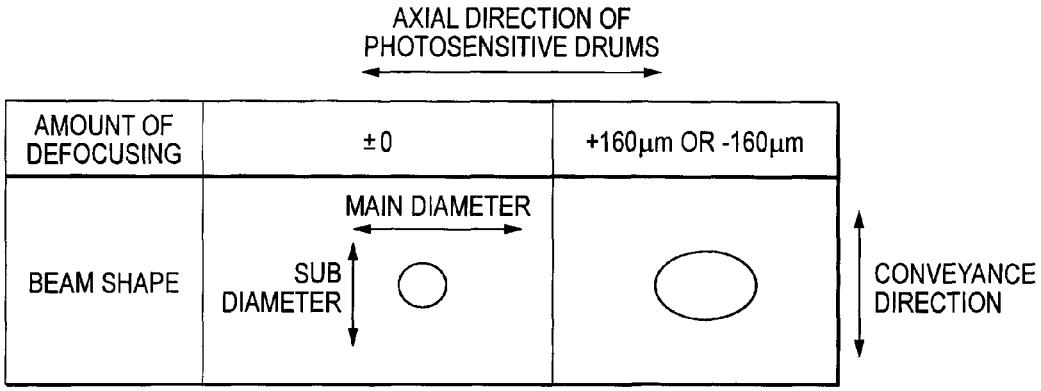
FIG. 5 is an explanatory view of beam shapes of the LED exposure head.
Figure 6:
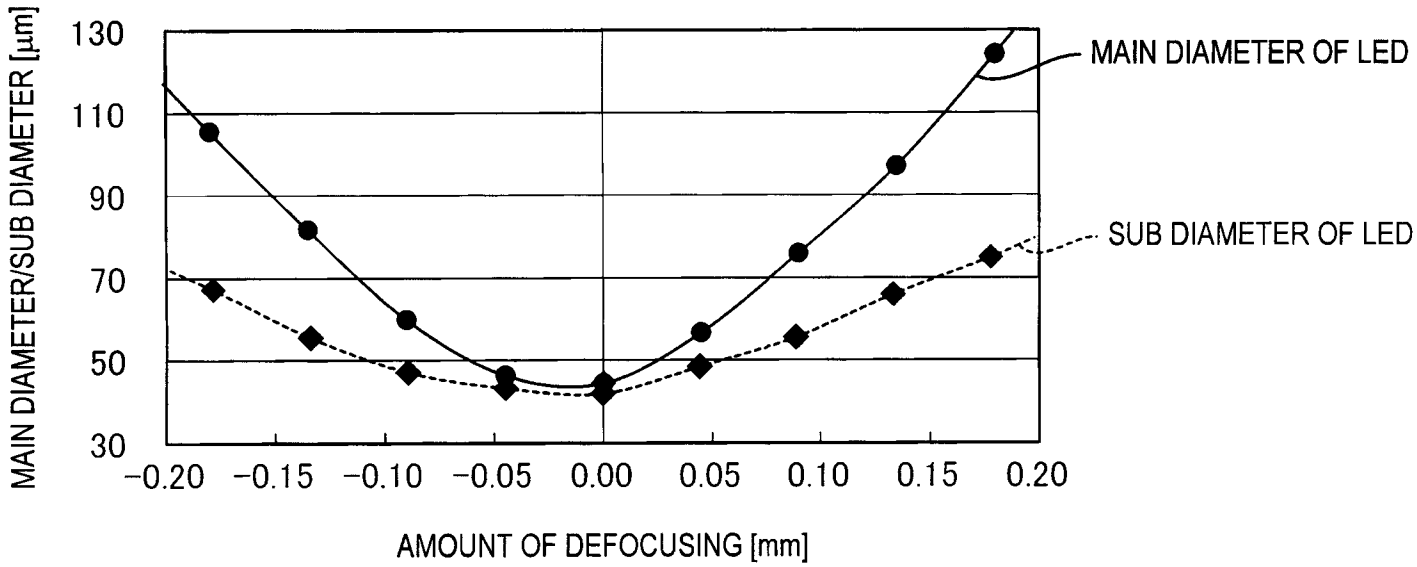
FIG. 6 is a graph illustrating the relation between an amount of defocusing and the diameters of the beam.

Next, the image 5 for developing-bias correction according to the present exemplary embodiment will be described with reference to FIGS. 5 to 8. FIG. 5 is a view illustrating beam shapes of the LED exposure heads 41, and FIG. 6 is a graph illustrating changes in a main diameter and a sub diameter relative to the amount of defocusing. Also, FIG. 7 is a plan view illustrating the image 5 for developing-bias correction, and FIG. 8 is an enlarged view illustrating a portion of FIG. 7.

Figure 7:
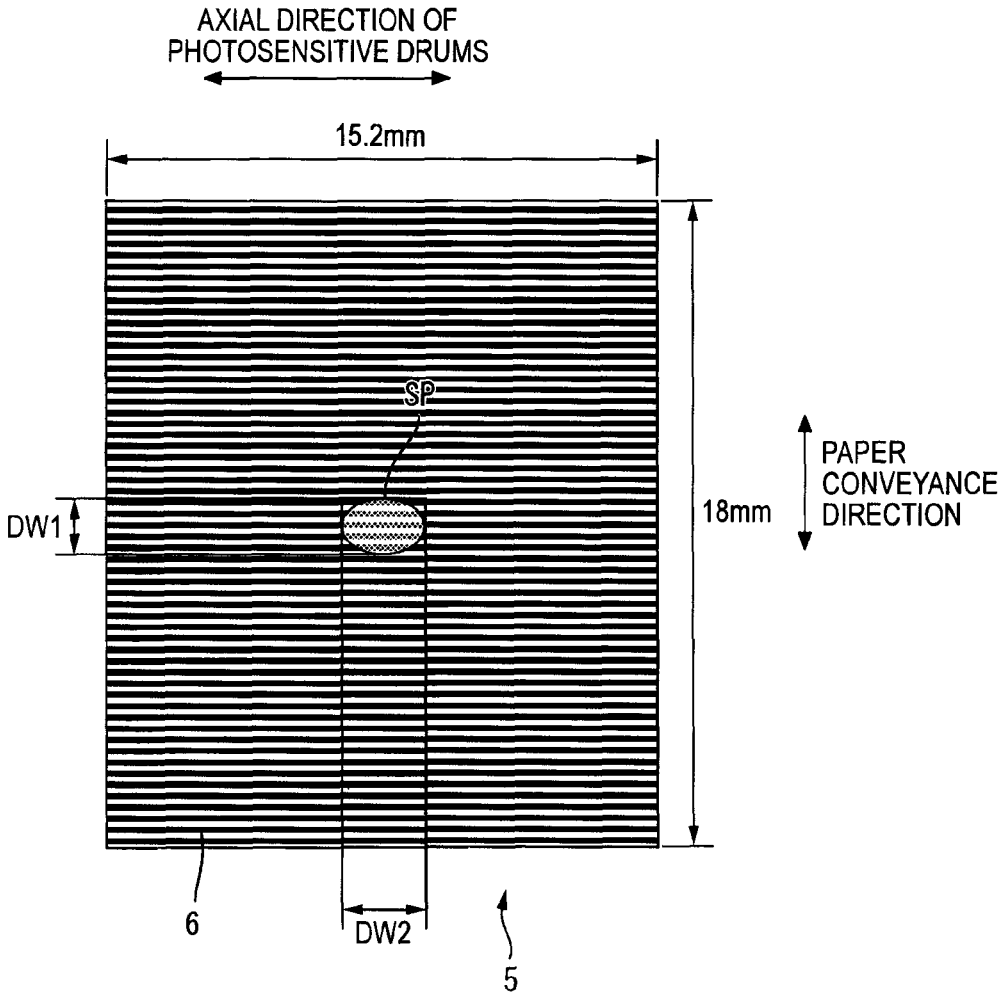
FIG. 7 is a plan view illustrating an image of for developing-bias correction.
Figure 8:
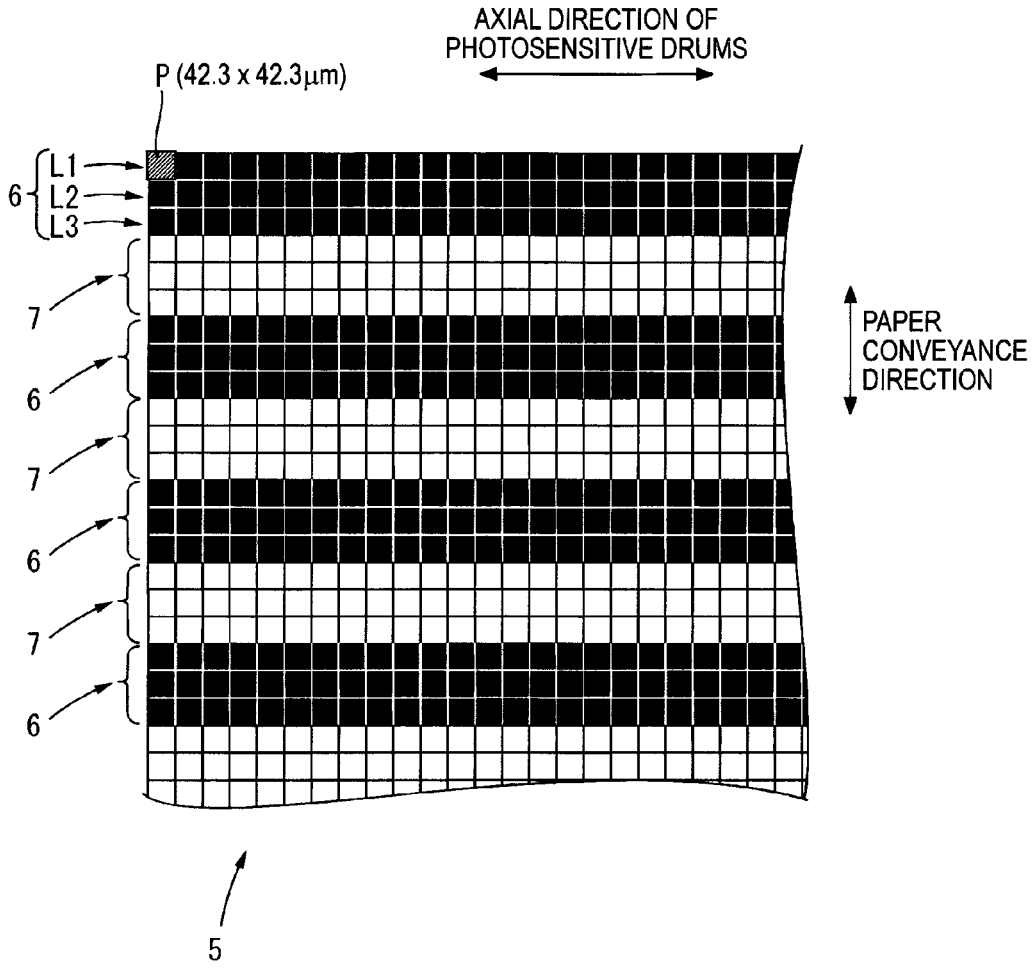
FIG. 8 is an enlarged view illustrating a portion of FIG. 6.

In the present exemplary embodiment, as an image for developing-bias correction, the image 5 for developing-bias correction including a plurality of transverse lines (correspond to the straight line portions) 6 as shown in FIG. 7 is used. This is because of the following reason.

That is, since the LED exposure heads 41 are installed close to the photosensitive drums 53, the depths of focus of the LED exposure heads 41 are small. Specifically, in general, depth of focus becomes small as numerical apertures of a lens system increases. Also, the numerical apertures of each LED exposure head 41 are set such that the numerical apertures in the axial direction of the photosensitive drums are larger than that in the paper conveyance direction (the front-rear direction in FIG. 1). Therefore, the LED exposure heads 41 have small depths of focus in the axial direction of the photosensitive drums.

Specifically, each LED exposure head 41 is an exposure head which includes diffractive index distribution type rod lenses integrally formed and arranged in 'm' rows in the axial direction of the photosensitive drums and 'n' columns in the recording-medium conveyance direction (m>n), and form the erected images of the luminous points of LEDs on the photosensitive drums 53 at the same magnification (see FIG. 3). Here, 'm' and 'n' are positive integers. Since 'm' is larger than 'n', the numerical aperture in the axial direction of the photosensitive drums is large, and thus the depth of focus in the axial direction of the photosensitive drums is small. In the present exemplary embodiment, 'm' is a value corresponding to a print area, and 'n' is 2.

Therefore, if the focal points of the LED exposure heads 41 shift in the optical axis direction (the upper-lower direction in FIG. 3) due to an error in the disposition of the LED array chips 41*b*, the cross-sectional shapes of the LED beams change from circular shapes. FIG. 5 shows LED beam cross-sections (corresponding to one dot) in a case where there is no defocusing and a case where there is defocusing of 160 μm. As shown in FIG. 5, in a case where the focal point of the LED exposure head 41 shift, the diameters of the beam cross-sections in the axial direction of the photosensitive drums (hereinafter, referred to as main diameters) and the diameters of the beam cross-sections in the paper conveyance direction (hereinafter, referred to as sub diameters) increase.

As shown in FIGS. 5 and 6, in the case where the focal points of the LED exposure head 41 shift, as described above, due to the difference in the numerical apertures of each LED exposure head 41 between the paper conveyance direction and the axial direction of the photosensitive drums, particularly, increases in the main diameters become outstanding. If the main diameters of the beam cross-sections of the LEDs increase as described above due to the defocusing of the LED exposure heads 41, exposure areas expand in the axial direction of the photosensitive drums. Therefore, with respect to some shapes of images for developing-bias correction, accurate images for developing-bias correction are unlikely to be formed. In other words, accurate concentration correction based on development-bias correction becomes difficult. Accordingly, in the present exemplary embodiment, as shown in FIG. 7, the image 5 for developing-bias correction including a plurality of transverse lines 6 is formed.

Each transverse line 6 corresponds to a straight line part extending in the axial direction of the photosensitive drums. Each transverse line 6 has a length equal to or larger than the second detection width DW2 of the spot light SP as shown in FIG. 7. The image 5 for developing-bias correction has a width of 15.2 mm (a length in the axial direction of the photosensitive drums) and a length of 18 mm (a length in the paper conveyance direction). If the image 5 for developing-bias correction is configured by transverse lines 6 having that shape, it is possible to reduce the influence according to expansion of the LED beam cross-sections in the axial direction of the photosensitive drums.

Also, as shown in FIG. 8, a pixel unit of the image 5 for developing-bias correction is an image dot P (hereinafter, referred to simply as dot) corresponding to an exposure unit (42.3(μm)×42.3(μm)) of the LED exposure heads 41. The individual transverse lines 6 are formed with predetermined intervals equal to or larger than a width defined by two dots P, as shown in FIG. 8. In the present exemplary embodiment, the individual transverse lines 6 are formed with intervals 7 corresponding to the width defined by three dots. This is because if the intervals 7 between the individual transverse lines 6 correspond to the width of one dot, an actual image 5 for developing-bias correction may become a beta image. For this reason, as described above, the intervals 7 between the individual transverse lines 6 are set to be equal to or larger than the width corresponding to two dots. Accordingly, it is possible to prevent the image 5 for developing-bias correction from becoming a beta image.

Also, each transverse line 6 is composed of straight unit lines L formed by dots consecutive in the axial direction of the photosensitive drums. Specifically, each transverse line 6 includes two or more straight unit lines L consecutive in the paper conveyance direction. In the present exemplary embodiment, each transverse line 6 includes three straight unit lines L1, L2, and L3 consecutive in the paper conveyance direction. This is because if each transverse line 6 is composed of only one straight unit line L, it is difficult for the toner to be provided thereon. If each transverse line 6 is configured by two or more straight unit lines L as described above, it is easy for the toner to be provided thereon, and thus it is possible to form an accurate image 5 for developing-bias correction.

4. Developing-Bias Correction Process and Gamma Correction Process

Figure 9:
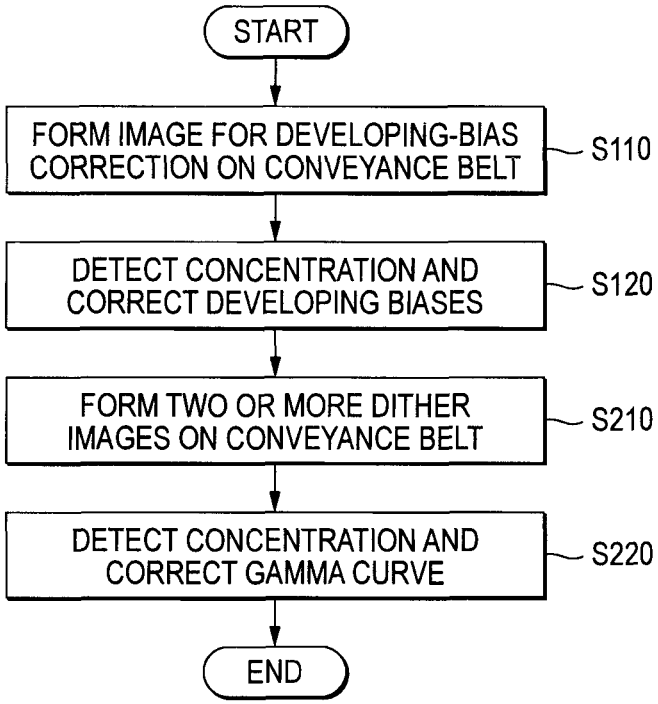
FIG. 9 is a flow chart schematically illustrating a developing-bias correction process and a gamma correction process.
Figure 10:
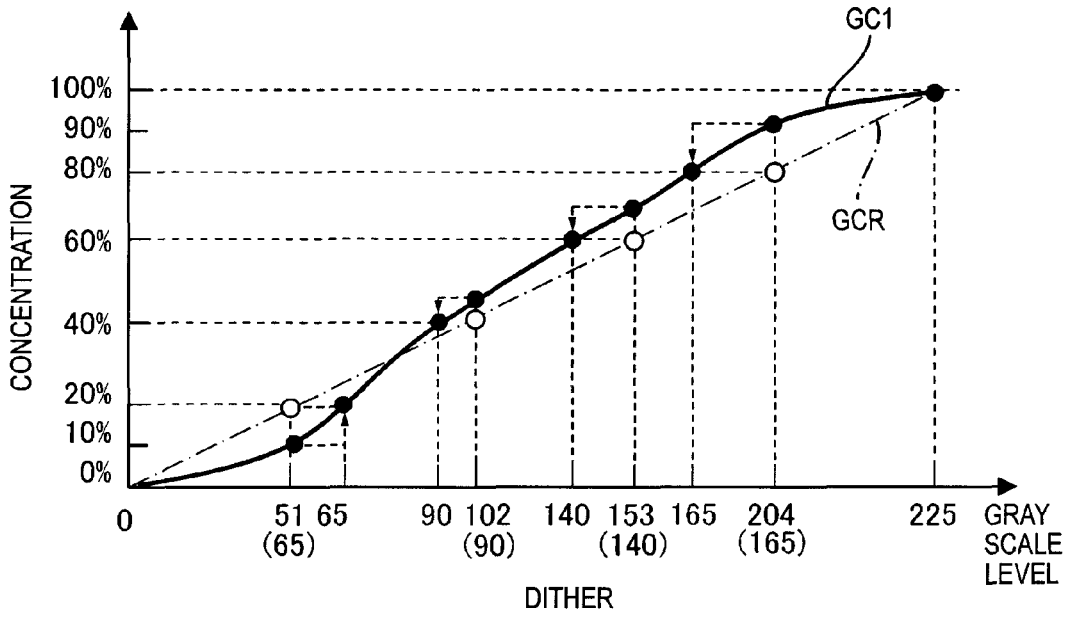
FIG. 10 is a graph illustrating gamma correction.
Figure 11:
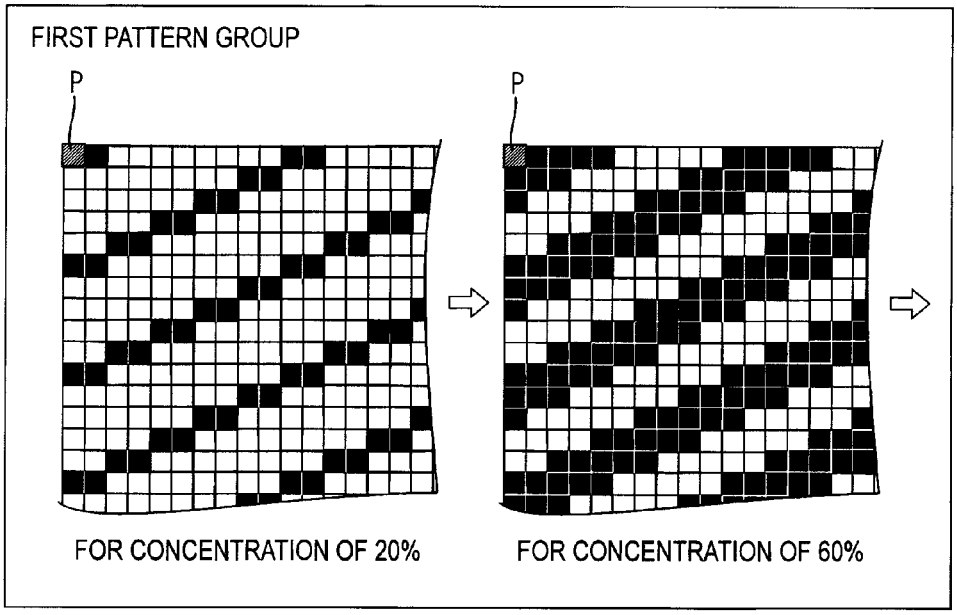
FIG. 11 is a plan view illustrating a dither pattern group.
Figure 12:
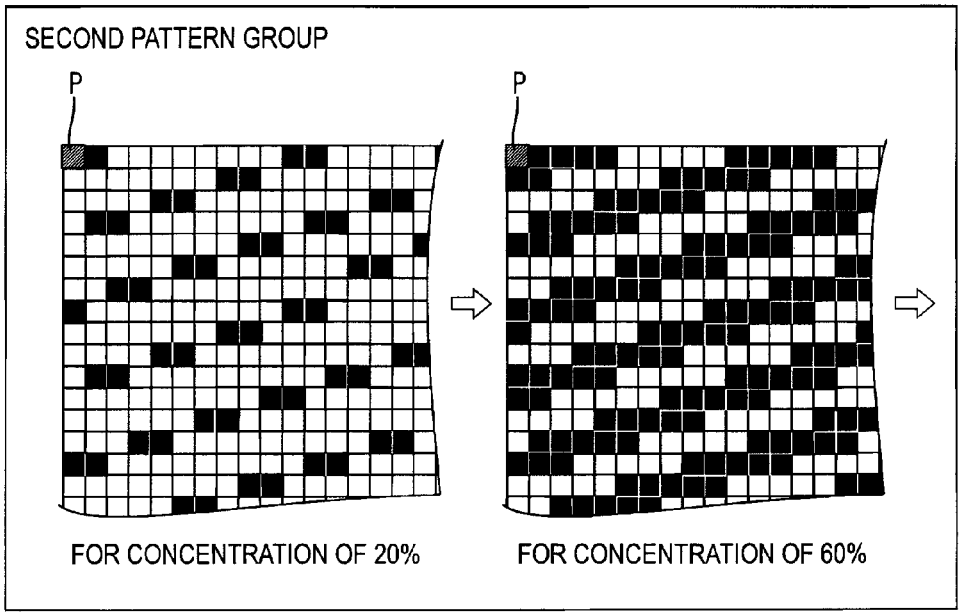
FIG. 12 is a plan view illustrating another dither pattern group.

Next, a developing-bias correction process and a gamma correction process will be described with reference to FIGS. 9 to 12. FIG. 9 is a flow chart illustrating the outline of the developing-bias correction process and the gamma correction process. FIG. 10 is a graph illustrating gamma correction. Also, FIGS. 11 and 12 are plan views illustrating two types of dither pattern groups for gamma correction. FIGS. 11 and 12 show only concentration patterns for concentrations of 20% and 60%. The developing-bias correction process and the gamma correction process are performed mainly by the control device 100 according to a predetermined program.

First, in STEP S110, the control device 100 controls the LED exposure heads 41 and the image forming unit 30 such that the image 5 for developing-bias correction shown in FIG. 5 is formed on the conveyance belt 73. Next, the control device 100 controls light emitting units of the concentration detecting sensors 25L and 25R such that the light emitting units emit light at a predetermined timing and irradiate the image 5 for developing-bias correction with the spot light SP. Subsequently, in STEP S120, the control device 100 acquires detection voltage values corresponding to the reflected light of the spot light SP from the concentration detecting sensors 25L and 25R, and corrects the developing biases DIV based on the detection voltage values. At this time, for example, the calculation control unit 100A of the control device 100 corrects the developing biases DIV with reference to the correction table RT. In the correction table RT, for example, there are the detection voltage values of the concentration detecting sensors 25L and 25R stored in association with development-bias correction values.

Next, the control device 100 controls the developing-bias generating circuit 110 such that the corrected developing biases DIV are generated, whereby two kinds of dither images having predetermined concentrations (corresponding to a second image for correction) are formed. In STEP S210, the control device 100 controls the LED exposure heads 41 and the image forming unit 30 such that two types of dither images of a predetermined concentration such as 20%, 40%, 60%, or 80% are formed on the conveyance belt 73. For example, for the concentration of 20%, the two types of dither images having the concentration of 20% and shown in FIGS. 11 and 12 are formed. Also, for the concentration of 60%, the two types of dither images having the concentration of 60% and shown in FIGS. 11 and 12 are formed.

The present invention is not limited to the case of using two types of dither images of each dither concentration. Three or more types of dither images may be used. In other words, it is preferable to use two or more types of dither images of each dither concentration.

Here, it is preferable to use two or more types of dither images of a dither concentration (predetermined concentration) because of the following reason.

When the concentration is simply high or low, it is only necessary to measure the dither concentration using one kind of dither image and offset (correct) a gamma curve according to the measurement result. However, in a case where defocusing of the LED array chips 41*b* occurs, a dark portion is likely to become darker since dots are crushed to overlap neighboring dots, and a light portion is likely to become lighter since dots are crushed and there are no dots strengthened by the neighboring dots. For this reason, in order to obtain an accurate gamma curve, it is preferable to use two or more dither images with respect to detection of each concentration. In other words, in the case where defocusing occurs in the LED array chips 41*b*, a high-concentration dither image is likely to be darker, and a low-concentration dither image is likely to be lighter. Therefore, in order to correct that change, it is preferable to measure each concentration using two or more dither images and to correct a gamma curve, for example, based on an average concentration of the measurement results.

Also, as dither images for correcting a gamma curve, it is preferable to use dither images which are susceptible to the influence on concentration detection by changes of exposure beam diameters in the axial direction of the photosensitive drums according to shifts of the focal positions of the exposure heads. For example, it is preferable to use oblique dither images as in the present exemplary embodiment. In a case of using oblique dither images, it is possible to perform the gamma correction more minutely. This is because of the following reason.

That is, as described above, in the case where defocusing occurs in the LED array chips 41*b*, since changes occur in all of the main diameters and sub diameters of the beams, the concentration of a printed specific dither image changes as compared to a case where there is no defocusing. For this reason, in the above-mentioned concentration correction, transverse line images free from the influence of changes in the main diameters are used. However, since the transverse line images are free from the influence of changes in the main diameters, the transverse line images cannot be said to be appropriate for examining a change in the concentration. In other words, in a case of examining a change in the concentration, only when dither images having a blank dot portion in each of a main direction and a sub direction like various dither images (oblique line/point group images) for color printers are used, it is possible to accurately examine the concentration change. Therefore, if dither images having a blank dot portion in each of a main direction and a sub direction are used, measurement of each concentration considering defocusing becomes possible.

Next, in STEP S220, the control device 100 controls the concentration detecting sensors 25L and 25R such that the control device 100 acquires the detection voltage values corresponding to each dither image, and detects the concentration of the corresponding dither image based on the detection voltage values. Also, the calculation control unit 100A calculates a gamma curve GC1 of the LED exposure heads 41 from each concentration. Further, in STEP S220, the calculation control unit 100A compares the data of the gamma curve GC1 with data representing the relation between each grayscale level (dither pattern) of an ideal gamma curve GCR and the concentration, and corrects the corresponding grayscale level (dither pattern).

For example, in a case where the grayscale level corresponding to the image data (dither pattern data) is 204, the concentration before correction is 90%. However, if the grayscale level is corrected to 165, the concentration of 80% is obtained. Similarly, in a case where the grayscale level corresponding to the image data is 51, the concentration before correction is 10%. However, if the grayscale level is corrected to 65, the concentration of 20% is obtained. If each grayscale level (dither pattern) of the image data is corrected in that way, it is possible to approximate the gamma curve GC1 to the ideal gamma curve GCR.

As described above, in the present exemplary embodiment, the gamma correction process is performed after the developing-bias correction process using the image 5 for developing-bias correction. Therefore, in an image forming apparatus including exposure heads having small depths of focus like the LED exposure heads 41, it is possible to reduce the amount of correction of developing biases during development-bias correction, and thus to ensure the accuracy of gamma correction. As a result, in the image forming apparatus using the LED exposure heads 41, it is possible to ensure desired image quality reproducibility. Also, if the amount of correction of the developing biases DIV is large, target dither patterns are different for individual colors, and thus the image quality reproducibility is reduced. For this reason, particularly, in the color printer 1, it is possible to suppress a reduction in the image quality reproducibility of a color image.

The developing-bias correction process (STEPS S110 and S120) and the gamma correction process (STEPS S210 and S220) may be performed before or after shipment of the color printer 1. In a case where the developing-bias correction process and the gamma correction process are performed before the shipment, for example, the developing-bias correction process and the gamma correction process may be performed by the control device 100, or the developing-bias correction process and the gamma correction process may be performed by the control device 100 and a predetermined gamma correction device, respectively. Also, in a case where the developing-bias correction process and the gamma correction process are performed after the shipment, for example, the developing-bias correction process may be performed when the power supply of the color printer 1 is turned on and the gamma correction process may be performed according to a process instruction of a user.

5. Effects of Exemplary Embodiment

In the LED exposure heads 41 disposed close to the photosensitive drums 53, since the depths of focus are small, defocusing is likely to occur. Also, in general, in a case where defocusing occurs, an exposure range tends to expand in the axis direction of the photosensitive member. For this reason, the image 5 for developing-bias correction is configured by the plurality of transverse lines 6 having lengths equal to or larger than the second detection width DW2 and extending in the axial direction of the photosensitive drums. Therefore, it is possible to suppress the influence of defocusing on concentration detection of the image 5 for developing-bias correction, that is, errors in the concentration detection. As a result, in the color printer 1 having the LED exposure heads 41 with small depths of focus, it is possible to suppress increases in the change widths of the developing biases DIV for image concentration correction such that correction of the developing biases DIV is appropriately conducted.

<Other Embodiments>

The present invention is not limited to the exemplary embodiments described above and shown in the drawings. For example, the following embodiments fall within the technical scope of the invention.

(1) In the above-mentioned embodiment, the two concentration detecting sensors 25L and 25R are provided to face both end portions of the conveyance belt 73 in the width direction, and the average value of the detection image concentrations detected by the concentration detecting sensors 25L and 25R is obtained. However, the present invention is not limited thereto. For example, one concentration detecting sensor 25 may be provided to face one end portion of the conveyance belt 73 in the width direction, and the developing biases DIV may be corrected based on a detection image concentration detected by the one concentration detecting sensor 25.

(2) In the above-mentioned embodiment, the image 5 for developing-bias correction (the first image for correction) includes a plurality of transverse lines (straight line portions) as shown in FIG. 7. However, the present invention is not limited thereto. The image 5 for developing-bias correction may include one transverse line 6. Also, the transverse lines 6 are not limited to straight lines going through from one end to the other end of the image 5 for developing-bias correction the axial direction of the photosensitive drums as shown in FIG. 7. In short, the image 5 for developing-bias correction may include a straight line portion having a length equal to or larger than the second detection width DW2 of the concentration detecting sensors 25. For example, in the image 5 for developing-bias correction shown in FIG. 7, the center portion of the image may include a straight line, and the edge portion of the image may include a curve.

(3) The light emitting elements P are not limited to LEDs. For example, the light emitting elements P may be organic ELs.

What is claimed is:

1. An image forming apparatus comprising:

a photosensitive member extending in an axial direction;

a conveying member configured to convey a recording medium in a predetermined conveyance direction;

an exposure head disposed close to the photosensitive member and configured to form a latent image on the photosensitive member by performing exposure based on image data;

a developing unit configured to develop the latent image formed on the photosensitive member;

an image forming unit configured to form an image obtained by the development by the developing unit on the recording medium or the conveying member;

a concentration sensor configured to detect an image and has a first detection width which is a detection width in the conveyance direction and a second detection width which is a detection width in the axial direction of the photosensitive member; and a control unit, wherein the control unit controls the exposure head and the image forming unit to form a first image for correction, which includes a straight line part extending in the axial direction of the photosensitive member and having a length equal to or larger than the second detection width of the concentration sensor, on the conveying member, and wherein the control unit corrects a developing bias to be applied to the developing unit for developing the latent image based on a detection result of a concentration of the first image for correction by the concentration sensor;

wherein gamma correction is performed after the developing bias is corrected;

wherein the control unit forms two or more types of second images for correction having a predetermined concentration on the conveying member and performs the gamma correction based on detection results of the second images for correction by the concentration sensor; and wherein the second image for correction is different from the first image for correction and includes a part which is not a straight line having a length equal to or larger than the second detection width of the concentration sensor.

2. The image forming apparatus according to claim 1, wherein the straight line part includes a plurality of straight line parts formed with a predetermined interval therebetween, wherein a pixel unit of the first image for correction is a pixel dot corresponding to an exposure unit of the exposure head, and wherein the predetermined interval is equal to or larger than a width defined by two pixel dots.

3. The image forming apparatus according to claim 2, wherein each of the straight line parts include two or more straight unit lines consecutive in the conveyance direction, the straight unit line formed by the pixel dots consecutive in the axial direction of the photosensitive member.

4. The image forming apparatus according to claim 1, wherein the second images for correction are dither images.

5. The image forming apparatus according to claim 1, wherein the image forming apparatus is configured to form color images, and wherein the photosensitive member, the exposure head and the image forming unit respectively include a plurality of photosensitive members, a plurality of exposure heads and a plurality of image forming units, correspondingly to a plurality of developers corresponding to colors for forming a color image.

6. The image forming apparatus according to claim 1, wherein the exposure head is an LED exposure head including a plurality of LEDs.

7. An image formation correcting method of performing correction relative to image formation in an image forming apparatus which includes a photosensitive member extending in an axial direction; a conveying member configured to convey a recording medium in a predetermined conveyance direction, an exposure head disposed close to the photosensitive member and configured to form a latent image on the photosensitive member by performing exposure based on image data, a developing unit configured to develop the latent image formed on the photosensitive member, an image forming unit configured to form an image obtained by the development by the developing unit on the recording medium or the conveying member and a concentration sensor configured to detect an image and has a first detection width which is a detection width in the conveyance direction and a second detection width which is a detection width in the axial direction of the photosensitive member, the method comprising:

controlling the exposure head and the image forming unit to form a first image for correction, which includes a straight line part extending in the axial direction of the photosensitive member and having a length equal to or larger than the second detection width of the concentration sensor, on the conveying member;

correcting a developing bias to be applied to the developing unit for developing the latent image based on a detection result of a concentration of the first image for correction by the concentration sensor; and after correcting the developing bias, forming two or more types of second images for correction, each having a predetermined concentration, on the conveying member, and performing gamma correction based on detection results of the second images for correction by the concentration sensor;

wherein the second image for correction is different from the first image for correction and includes a part which is not a straight line having a length equal to or larger than the second detection width of the concentration sensor.

8. The image formation correcting method according to claim 7, wherein the straight line part includes a plurality of straight line parts formed with a predetermined interval therebetween, wherein a pixel unit of the first image for correction is a pixel dot corresponding to an exposure unit of the exposure head, and wherein the predetermined interval is equal to or larger than a width defined by two pixel dots.

9. The image formation correcting method according to claim 8, wherein each of the straight line parts include two or more straight unit lines consecutive in the conveyance direction, the straight unit line formed by the pixel dots consecutive in the axial direction of the photosensitive member.

10. The image formation correcting method according to claim 7, wherein the second images for correction are dither images.

11. The image formation correcting method according to claim 7, wherein the image forming apparatus is configured to form color images, and wherein the photosensitive member, the exposure head and the image forming unit respectively include a plurality of photosensitive members, a plurality of exposure heads and a plurality of image forming units, correspondingly to a plurality of developers corresponding to colors for forming a color image.

12. The image formation correcting method according to claim 7, wherein the exposure head is an LED exposure head including a plurality of LEDs.

* * * * *